US010043445B2

(12) United States Patent
Qing

(10) Patent No.: US 10,043,445 B2
(45) Date of Patent: Aug. 7, 2018

(54) PIXEL DRIVING CIRCUIT AND DRIVING METHOD THEREOF AND DISPLAY APPARATUS

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventor: Haigang Qing, Beijing (CN)

(73) Assignees: BOE TECHNOLOGY GROUP CO., LTD., Beijing (CN); CHENGDU BOE OPTOELECTRONICS TECHNOLOGY CO., LTD., Chengu, Sichuan (CN)

( * ) Notice: Subject to any disclaimer, the term of this patent is extended or adjusted under 35 U.S.C. 154(b) by 13 days.

(21) Appl. No.: 14/906,011

(22) PCT Filed: Jun. 18, 2015

(86) PCT No.: PCT/CN2015/081735
§ 371 (c)(1),
(2) Date: Jan. 19, 2016

(87) PCT Pub. No.: WO2016/119377
PCT Pub. Date: Aug. 4, 2016

(65) Prior Publication Data

US 2016/0372036 A1 Dec. 22, 2016

(30) Foreign Application Priority Data

Jan. 30, 2015 (CN) ..... 2015 1 0051381

(51) Int. Cl.
*G09G 3/3233* (2016.01)
*G09G 3/325* (2016.01)
*G09G 3/3258* (2016.01)

(52) U.S. Cl.
CPC ..... *G09G 3/3233* (2013.01); *G09G 3/325* (2013.01); *G09G 3/3258* (2013.01);
(Continued)

(58) Field of Classification Search
CPC .... G09G 3/3233; G09G 3/325; G09G 3/3258; G09G 2300/0861; G09G 2300/0852; G09G 2320/0252; G09G 2320/0626
See application file for complete search history.

(56) References Cited

U.S. PATENT DOCUMENTS

2003/0090447 A1* 5/2003 Kimura ..... G09G 3/3241 345/82
2005/0062692 A1 3/2005 Lo et al.
(Continued)

FOREIGN PATENT DOCUMENTS

CN 102411893 A 4/2012
CN 202422687 U 9/2012
(Continued)

OTHER PUBLICATIONS

International Search Report and Written Opinion dated Oct. 29, 2015; PCT/CN2015/081735.
(Continued)

*Primary Examiner* — Amr Awad
*Assistant Examiner* — Andre Matthews
(74) *Attorney, Agent, or Firm* — Ladas & Parry LLP

(57) ABSTRACT

Provided are a pixel driving circuit, driving method thereof, and a display apparatus. The pixel driving circuit comprises a storage module (1), a light emitting module (2), a driving transistor ($T_D$), and a voltage-adjusting module (3); the storage module (1) is connected to a first control signal terminal (S1), a data current input terminal (1), the driving transistor ($T_D$) and the voltage-adjusting module (3) respectively, and is configured to store a gate-source voltage of the
(Continued)

driving transistor ($T_D$) when data current flows through the driving transistor ($T_D$) under the control of a first control signal; the light-emitting module (2) is connected to a second control signal terminal (S2), a power voltage terminal (V1) and the driving transistor ($T_D$) respectively, and is configured to emit light according to the light emitting current ($I_{oled}$) in the driving transistor ($T_D$) under the control of a second control signal; the voltage-adjusting module (3) is connected to the second control signal terminal (S2) and the storage module (1) respectively, and is configured to decrease the voltage stored by the storage module (1) under the control of the second control signal to control to reduce the light emitting current ($I_{oled}$) in the driving transistor ($T_D$) by a preset scale with respect to the data current ($I_{data}$). It is possible to improve display accuracy.

19 Claims, 6 Drawing Sheets

(52) U.S. Cl.
CPC ..... *G09G 2300/0852* (2013.01); *G09G 2300/0861* (2013.01); *G09G 2310/0251* (2013.01); *G09G 2320/0252* (2013.01); *G09G 2320/0626* (2013.01)

(56) References Cited

U.S. PATENT DOCUMENTS

| | | | | |
|---|---|---|---|---|
| 2011/0032232 | A1 | 2/2011 | Smith | |
| 2011/0210990 | A1* | 9/2011 | Kim ..... | G09G 3/3233 345/690 |
| 2014/0117862 | A1 | 5/2014 | Qing et al. | |
| 2014/0152190 | A1* | 6/2014 | Tan ..... | G09G 3/3241 315/228 |
| 2015/0028766 | A1 | 1/2015 | Yang | |
| 2015/0084842 | A1 | 3/2015 | Kim et al. | |
| 2015/0170572 | A1 | 6/2015 | Qing et al. | |
| 2015/0287359 | A1 | 10/2015 | Qing et al. | |
| 2015/0302798 | A1 | 10/2015 | Tan | |

FOREIGN PATENT DOCUMENTS

| | | | |
|---|---|---|---|
| CN | 102708798 | A | 10/2012 |
| CN | 103198793 | A | 7/2013 |
| CN | 103413520 | A | 11/2013 |
| CN | 103474022 | A | 12/2013 |
| CN | 103531150 | A | 1/2014 |
| CN | 104200789 | A | 12/2014 |
| CN | 104318899 | A | 1/2015 |
| JP | 2004-317707 | A | 11/2004 |

OTHER PUBLICATIONS

Second Chinese Office Action dated Mar. 1, 2017; Appln. No. 201510051381.0.

Extended European Search Report dated Jun. 4, 2016; Appln. No. 15832937.5.

* cited by examiner

PIXEL DRIVING CIRCUIT AND DRIVING METHOD THEREOF AND DISPLAY APPARATUS

TECHNICAL FIELD OF THE DISCLOSURE

The present disclosure relates to a pixel driving circuit and driving method thereof, and a display apparatus.

BACKGROUND

With the development of the display technologies, OLED (Organic Light Emitting Diode) has been widely applied. In an OLED display panel, for each pixel, one pixel driving circuit containing OLEDs is arranged for displaying the corresponding pixel.

In known technologies, a pixel driving circuit can comprise a driving transistor, OLEDs, a storage capacitor, some transistors for controlling ON/OFF of the circuit, and so on. The driving process of the pixel driving circuit comprises two phases which are a programming phase and a light-emitting phase. In the programming phase (the first phase), a gate and a drain of the driving transistor are connected such that the driving transistor is in the saturation state, date current $I_{data}$ flows through the driving transistor, and the storage capacitor records the gate-source voltage of the driving transistor under the data current. In the light-emitting phase (the second phase), the driving transistor is in the saturation state by controlling VDD and VSS. In this case, the gate-source voltage of the driving transistor is the voltage recorded by the capacitor. It can be known that the current of the driving transistor is $I_{data}$ based on the relationship between the current and the gate-source voltage of the driving transistor in the saturation state. The current is also the light emitting current $I_{oled}$ of the OLED.

SUMMARY

An embodiment of the present disclosure provides a pixel driving circuit and driving method thereof, and a display apparatus. The technical solutions are as follows.

In a first aspect, there is provided a pixel driving circuit comprising a storage module, a light emitting module, a driving transistor and a voltage-adjusting module, wherein the storage module is connected to a first control signal terminal, a data current input terminal, the driving transistor and the voltage-adjusting module respectively, and is configured to store a gate-source voltage of the driving transistor when data current flows through the driving transistor under the control of a first control signal; the light-emitting module is connected to a second control signal terminal, a power voltage terminal and the driving transistor respectively, and is configured to emit light according to the light emitting current in the driving transistor under the control of a second control signal; the voltage-adjusting module is connected to the second control signal terminal and the storage module respectively, and is configured to decrease the voltage stored by the storage module under the control of the second control signal to control to reduce the light emitting current in the driving transistor by a preset scale with respect to the data current.

Optionally, the storage module comprises at least a storage capacitor and a matching transistor connected to each other in series, and the matching transistor and the driving transistor have the same threshold voltage.

Optionally, the voltage-adjusting module comprises a voltage-reducing capacitor and a first transistor; and the first transistor is arranged in a branch where the voltage-reducing capacitor connects with the storage capacitor in parallel, and is configured to control the voltage-reducing capacitor to be connected with the storage capacitor in parallel according to the second control signal.

Optionally, the pixel driving circuit further comprises a discharge module which is configured to discharge the storage capacitor and the voltage-reducing capacitor before the storage module stores the gate-source voltage of the driving transistor under the control of the first control signal.

Optionally, the discharge module comprises a second transistor.

Optionally, the storage module further comprises a fourth transistor and a fifth transistor which are arranged in a line connecting a gate and a source of the driving transistor and are connected to the first control signal terminal and the data current input terminal respectively; the fourth transistor and the fifth transistor are configured to connect the gate and the source of the driving transistor and input the data current into the source of the driving transistor and the storage capacitor under the control of the first control signal.

Optionally, the light-emitting module comprises a light-emitting device and a third transistor; and the light-emitting device is arranged in a line between the third transistor and the power voltage terminal.

In a second aspect, there is provided a display apparatus comprising pixel driving circuits as described in the above.

In a third aspect, there is provided a driving method of a pixel driving circuit, comprising: a storage module storing a gate-source voltage of a driving transistor when data current flows through the driving transistor under the control of a first control signal; and a light-emitting module emitting light according to light emitting current in the driving transistor under the control of a second control signal, and a voltage-adjusting module decreasing the voltage stored by the storage module under the control of the second control signal to control to reduce the light emitting current in the driving transistor by a preset scale with respect to the data current.

Optionally, before the storage module stores the gate-source voltage of the driving transistor when the data current flows through the driving transistor under the control of the first control signal, the method further comprises: a discharge module discharging a storage capacitor and a voltage-reducing capacitor according to the first control signal.

Optionally, the light-emitting module emitting light according to light emitting current in the driving transistor under the control of the second control signal, and the voltage-adjusting module decreasing the voltage stored by the storage module under the control of the second control signal to control to reduce the light emitting current in the driving transistor by a preset scale with respect to the data current comprises: upon reaching a preset time length after the storage module finishes storing the gate-source voltage of the driving transistor, the light-emitting module emitting light according to light emitting current in the driving transistor under the control of the second control signal, and the voltage-adjusting module decreasing the voltage stored by the storage module under the control of the second control signal to control to reduce the light emitting current in the driving transistor by a preset scale with respect to the data current.

In embodiments of the present disclosure, the voltage stored by the storage module is decreased by the voltage-adjusting module to control the light emitting current in the driving transistor to decrease by a preset scale with respect to the data current. As a result, it is possible to use relatively strong data current to trigger relatively weak light emitting current, improve storing speed when storing the gate-source voltage of the driving transistor, and thus improve display accuracy.

DETAILED DESCRIPTION

When implementing the present disclosure, the inventor(s) has/have found at least the following problems in the known technologies. When a pixel point corresponding to a driving circuit is to display low gray-scale content, the light emitting current $I_{oled}$ is small, and thus the required $I_{data}$ is also small. As a result, the charging speed of the storage capacitor is slow. If the charging cannot be finished within a predefined time length duration of the programming phase, the voltage recorded by the storage capacitor will be relatively small, resulting in inaccurate $I_{oled}$, and further causing inaccurate display.

In the following, detailed description will be further made on embodiments of the present disclosure in connection with figures.

Figure 1:
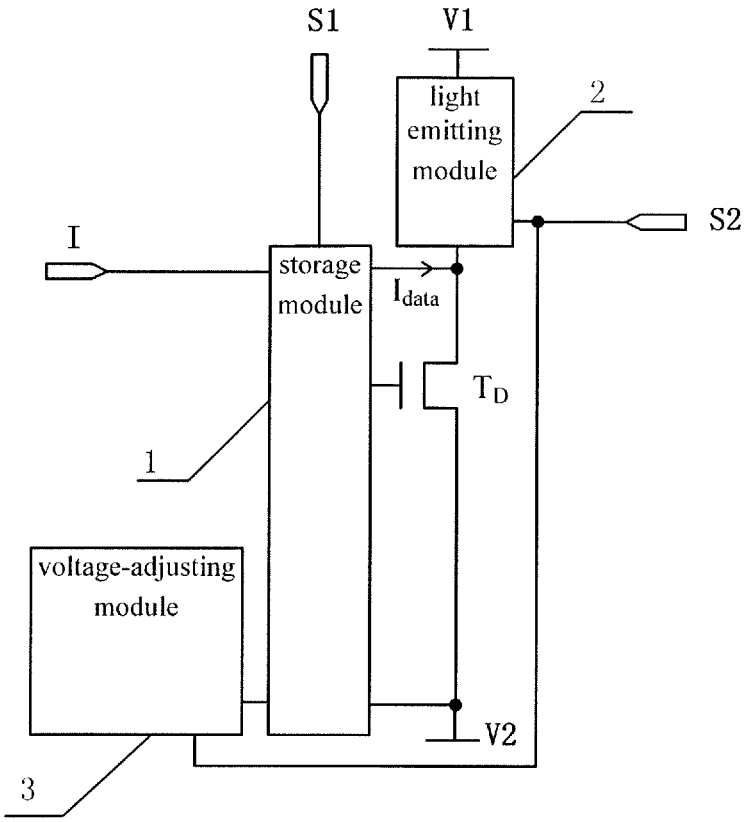
FIG. 1 is a schematic diagram of a circuit structure of a pixel driving circuit provided by an embodiment of the present disclosure.

An embodiment of the present disclosure provides a pixel driving circuit, as shown in FIG. 1. The pixel driving circuit can comprise a storage module 1, a light emitting module 2, a voltage-adjusting module 3 and a driving transistor $T_D$, wherein the storage module 1 is connected to a first control signal terminal S1, a data current input terminal I, the driving transistor $T_D$ and the voltage-adjusting module 3 respectively, and is configured to store a gate-source voltage of the driving transistor $T_D$ when data current flows through the driving transistor $T_D$ under the control of a first control signal; the light-emitting module 2 is connected to a second control signal terminal S2, a power voltage terminal V1 and the driving transistor $T_D$ respectively, and is configured to emit light according to the light emitting current in the driving transistor $T_D$ under the control of the second control signal; the voltage-adjusting module 3 is connected to the second control signal terminal S2 and the storage module 1 respectively, and is configured to decrease the voltage stored by the storage module 1 under the control of the second control signal to control to reduce the light emitting current in the driving transistor $T_D$ by a preset scale with respect to the data current.

In an embodiment of the present disclosure, the voltage stored by the storage module is decreased by the voltage-adjusting module to control the light emitting current in the driving transistor to decrease by a preset scale with respect to the data current. As a result, it is possible to use relatively strong data current to trigger relatively weak light emitting current, improve storing speed when storing the gate-source voltage of the driving transistor, and thus improve display accuracy.

In implementation, the first control signal can be a scan signal referred to as S(n). The second control signal can be a light-emitting control signal referred to as EM(n). The first control signal and the second control signal are digital signals which can have the same signal period that is the operation period of the pixel driving circuit. The storage module 1 can comprise a storage capacitor C1 and can also comprise a transistor for circuit control, which is configured to connect the gate with the drain of the driving transistor $T_D$ and input the data current (which can be referred to as $I_{data}$) to the gate of $T_D$ and the storage capacitor C1 under the control of the scan signal. The source of the driving transistor $T_D$ can be connected to a low potential terminal V2. The voltage VSS of the low potential terminal V2 can be 0 or a preset relatively low value. In addition to the above functions, the storage module 1 can be configured to input the data current into the driving transistor under the control of the first control signal.

During the driving process of the above pixel driving circuit, each operation period can comprise at least a programming phase and a light emitting phase. In the programming phase, the first control signal can control to input the data current into the drain of the driving transistor, control to connect the drain and the gate of the driving transistor, and control the storage module 1 to start operation. The storage module 1 stores the gate-source voltage of the driving transistor $T_D$ when the data current flows through the driving transistor $T_D$. Then in the light emitting phase, the second control signal controls the light-emitting module 2 to emit light according to the light emitting current in the driving transistor $T_D$, and the second control signal controls the voltage-adjusting module 3 to start operation. The voltage-adjusting module 3 reduces the voltage stored by the storage module 1 to adjust the light emitting current (which can be referred to as $I_{oled}$) in the driving transistor $T_D$, to make the data current and the light emitting current meet the preset scale. In such away, the light emitting current is smaller than the data current in intensity. Therefore, it is possible to trigger relatively weak light emitting current by relatively strong data current, and thus improve storage speed when storing the gate-source voltage of the driving transistor to improve display accuracy. At the same time, since the data current and the light emitting current meet the preset scale, it is possible to control the intensity of the light emitting current by controlling the intensity of the data current based on the preset scale.

Figure 2:
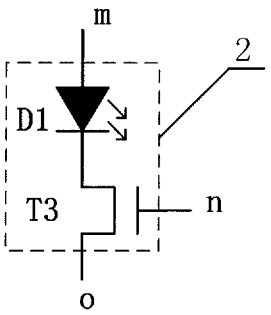
FIG. 2 is a schematic diagram of a circuit structure of a pixel driving circuit provided by an embodiment of the present disclosure.

Optionally, as shown in FIG. 2, the light-emitting module 2 can comprise a light emitting device D1 and a third transistor T3.

In implementation, the light emitting device D1 can be an OLED such as an AMOLED (Active Matrix Driving OLED). One terminal (i.e., terminal m in the figure) of the light emitting device D1 can be connected to the power voltage terminal V1, and the other terminal can be connected to the drain of the third transistor T3. The gate (i.e., terminal n in the figure) of the third transistor T3 can be connected to the second control signal terminal S2, and the source (i.e., terminal o in the figure) of the third transistor T3 can be connected to the drain of the driving transistor $T_D$.

In the programming phase, the second control signal can be a low voltage level, the third transistor T3 is turned off, and the light emitting device D1 does not emit light. In the light emitting phase, the second control signal can be a high voltage level, the third transistor T3 is turned on, and in this case the driving transistor $T_D$ is also turned on. The light emitting device D1 emits light under the effect of the power voltage VDD. In the above manner, it is possible to avoid the light emitting device D1 to emit light with incorrect intensity in the programming phase.

Optionally, the storage module 1 can comprise at least a storage capacitor C1 and a matching transistor $T_M$ connected to each other in series, wherein the matching transistor $T_M$ and the driving transistor $T_D$ have the same threshold voltage.

Figure 3:
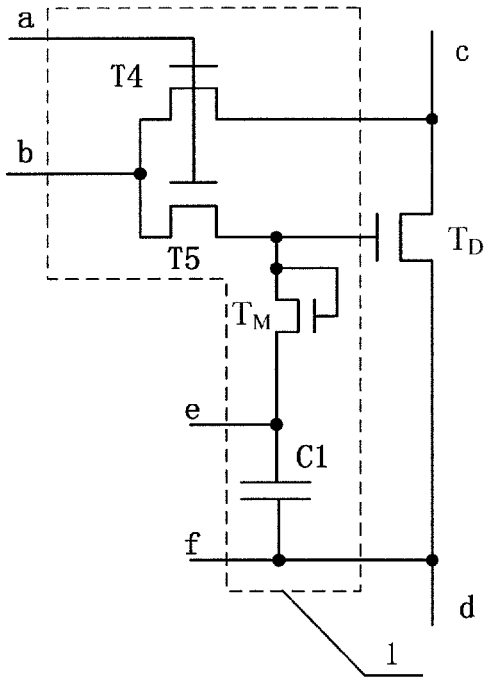
FIG. 3 is a schematic diagram of a circuit structure of a pixel driving circuit provided by an embodiment of the present disclosure.

In implementation, in one case, the structure of the storage module 1 and its connection relationship with the driving transistor $T_D$ can be as shown in FIG. 3. The storage module 1 can also comprise a fourth transistor T4 and a fifth transistor T5 arranged in a line connecting the gate and the source of the driving transistor and connected to the first control signal terminal and the data current input terminal respectively. The fourth transistor T4 and the fifth transistor T5 can be configured to connect the gate and the source of the driving transistor and input the data current into the source of the driving transistor and the storage capacitor under the control of the first control signal. Terminal a can be connected to the first control signal terminal S1, terminal b can be connected to the data current input terminal I, terminal c can be connected to the light emitting module 2, terminal d can be connected to the low potential terminal V2, and terminal e and terminal f can be connected to the voltage-adjusting module 3. The gate and the drain of the matching transistor $T_M$ can be connected such that the matching transistor $T_M$ can be equivalent to a diode. The matching transistor $T_M$ and the driving transistor $T_D$ can be two transistors with the same electrical characteristic, so they can be considered to have the same threshold voltage.

In the programming phase, the first control signal can be a high voltage level, the fourth transistor T4 and the fifth transistor T5 are turned on to connect the gate and the drain of the driving transistor $T_D$, and the driving transistor $T_D$ enters into the saturation state. One part of the data current flows through the driving transistor $T_D$ via the fourth transistor T4, and the other part flows into the storage capacitor C1 through the fifth transistor T5 and the matching transistor $T_M$ (equivalent to a diode) to charge the storage capacitor C1 until the voltage between the two terminals of the storage capacitor C1 no longer changes. Now, all the data current flows through the driving transistor $T_D$. The following expression can be obtained based on the relationship between the current and the gate-source voltage of the transistor in the saturation state:

$$I_{data}=(V1+V_{thm}-V_{thd})^2\times k/2=V1^2\times k/2 \quad (1)$$

where V1 is the voltage of C1 after being charged, $V_{thm}$ is the threshold voltage of the matching transistor $T_M$, $V_{thd}$ is the threshold voltage of the driving transistor $T_D$, and k is a constant related to the production process of the transistor.

With the above process in the programming phase, it is possible to indirectly store the gate-source voltage of the driving transistor $T_D$ by the voltage between the two terminals of the storage capacitor C1 after being charged.

Optionally, the voltage-adjusting module 3 can comprise a voltage-reducing capacitor C2 and a first transistor T1; and the first transistor T1 is arranged in a branch where the voltage-reducing capacitor C2 connects with the storage capacitor C1 in parallel, and is configured to control the voltage-reducing capacitor C2 to be connected with the storage capacitor C1 in parallel according to the second control signal.

Figure 4:
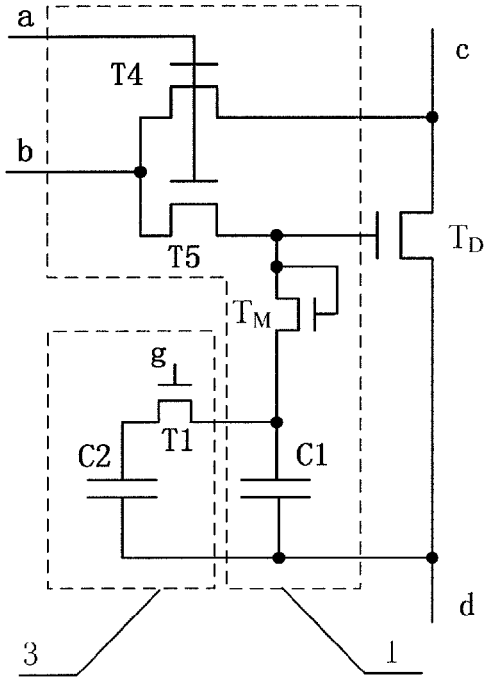
FIG. 4 is a schematic diagram of a circuit structure of a pixel driving circuit provided by an embodiment of the present disclosure.

In implementation, the circuit structures of the voltage adjusting module 3 and the storage module 1 can be as shown in FIG. 4. The voltage-reducing capacitor C2 is connected with the storage capacitor C1 in parallel, the first transistor T1 is arranged in the parallel branch of C1, and the gate (e.g., terminal g in the figure) of the first transistor T1 can be connected to the second control signal terminal S2.

In the programming phase, the second control signal can be a low voltage level, the first transistor T1 is turned off, and the voltage-reducing capacitor C2 has no effect. In the light emitting phase, the second control signal can be a high voltage level, the first transistor T1 is turned on, and the voltage-reducing capacitor C2 is connected to the two terminals of the storage capacitor C1 in parallel to redistribute the charges in the storage capacitor C1. Based on the charge conservation principle, the following expression can be obtained:

$$C1\times V1=(C2+C1)\times V_x \quad (2)$$

where Vx is the voltage between the two terminals of the storage capacitor C1 and the voltage-reducing capacitor C2 after the two capacitors are connected in parallel, and obviously, Vx is smaller than V1.

Based on the above expression (2), the above expression can be further derived:

$$V_X=C1\times V1/(C2+C1) \quad (3)$$

Now, the gate-source voltage of the driving transistor $T_D$ is sum of the voltage between the two terminals of the storage capacitor C1 and the threshold voltage of the matching transistor $T_M$. The values of VDD and VSS can be set in advance to ensure that the storage driving transistor $T_D$ is in the saturation state in the light emitting stage. Now, the current flowing through the driving transistor $T_D$ is the light emitting current $I_{oled}$ of the light emitting device. Based on the relationship between the current and the gate-source voltage of the transistor in the saturation state, the following expression can be obtained:

$$\begin{aligned} I_{oled} &= (Vx+V_{thm}-V_{thd})^2\times k/2 \\ &= (C1\times V1/(C2+C1))^2\times k/2 \\ &= V1^2\times(C1/(C2+C1))^2\times k/2 \end{aligned} \quad (4)$$

Based on the above expression (1) and expression (4), the following expression can be further derived:

$$I_{data}/I_{oled}=1/(C1/(C2+C1))^2=(C2+C1)^2/C1^2 \quad (5)$$

In such a way, in the light emitting phase, the intensity of the light emitting current $I_{oled}$ flowing through the light emitting device D1 is reduced by a scale, compared with the intensity of the data current $I_{data}$. It is possible to set the reduction scale of the light emitting current with respect to the data current by adjusting the capacitance of the storage capacitor C1 and the voltage-reducing capacitor C2.

Optionally, the pixel driving circuit can further comprise a discharge module 4, which is configured to discharge the storage capacitor C1 and the voltage-reducing capacitor C2 before the storage module 1 stores the gate-source voltage of the driving transistor $T_D$ under the control of the first control signal.

The discharge module 4 can comprise a second transistor T2.

Figure 5:
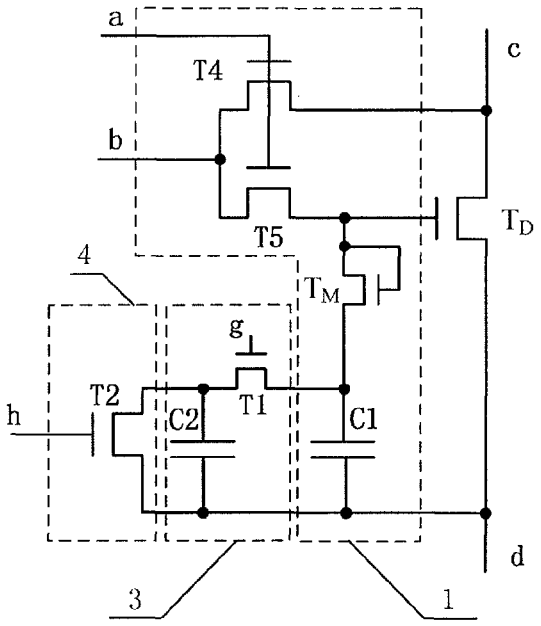
FIG. 5 is a schematic diagram of a circuit structure of a pixel driving circuit provided by an embodiment of the present disclosure.

In implementation, the circuit structure of the discharge module 4 can be as shown in FIG. 5. The gate (i.e., terminal h in the figure) of the second transistor T2 can be connected to the first control signal terminal S1, and the source and the drain thereof can be connected to the two terminals of the voltage-reducing capacitor C2 respectively. In such a way, if the second control signal controls the voltage-reducing capacitor C2 to be connected with the storage capacitor C1 in parallel, the second transistor T2 can cause the voltage-reducing capacitor C2 and the storage capacitor C1 to be short-circuited under the control of the first control signal to make them discharge.

Based on the above discharge module 4, before the programming phase, a discharge phase can be arranged in which the first control signal and the second control signal are both high voltage levels. When one operation period of the pixel driving circuit starts, the discharge phase is first entered, the first control signal and the second control signal are high voltage levels, the first transistor T1 and the second transistor T2 are both in a turning on state, and the voltage-reducing capacitor C2 and the storage capacitor C1 are connected in parallel and short-circuited to make the voltage-reducing capacitor C2 and the storage capacitor C1 discharge. The voltage $V_x$ between the two terminals of the capacitors in the light emitting phase of the last operation period is released.

Figure 6:
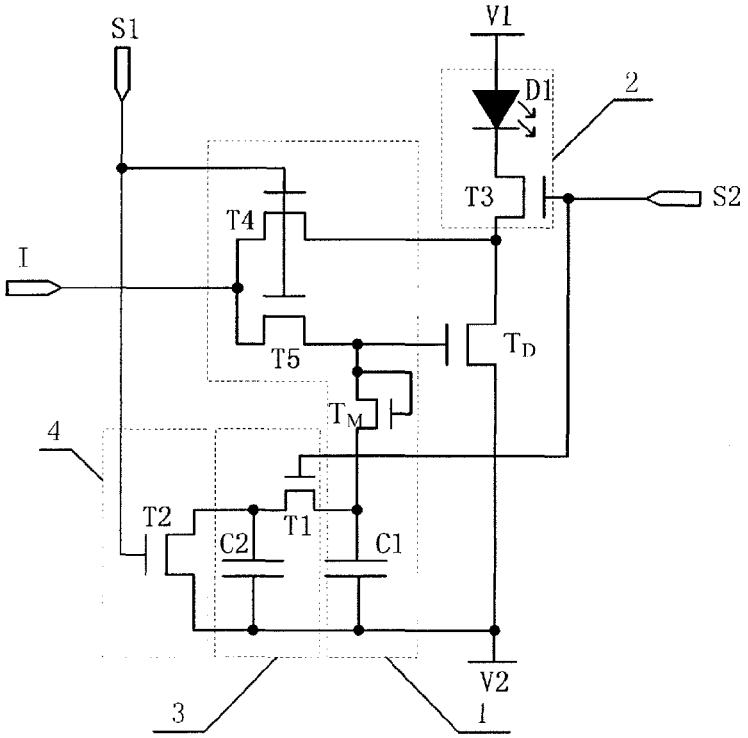
FIG. 6 is a schematic diagram of a circuit structure of a pixel driving circuit provided by an embodiment of the present disclosure.
Figure 8:
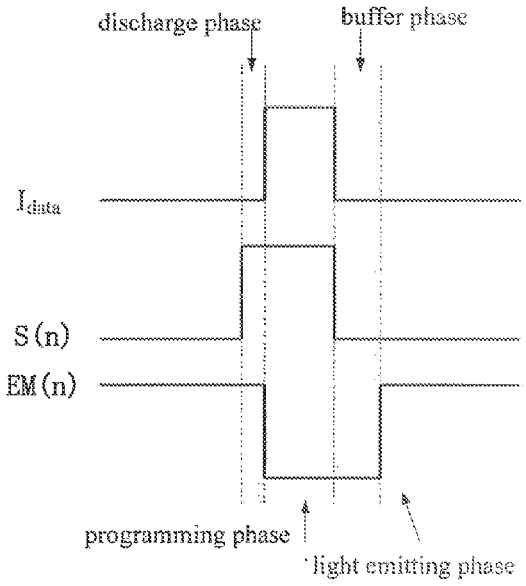
FIG. 8 is a time sequence diagram for an operation of a pixel driving circuit provided by an embodiment of the present disclosure.
Figure 9:
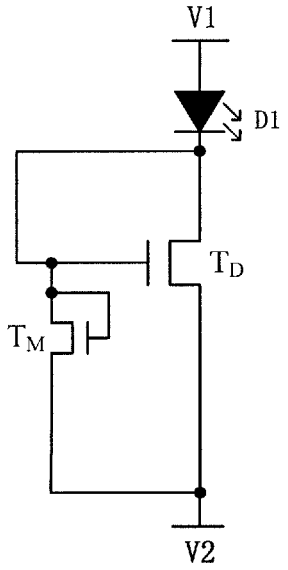
FIGS. 9(*a*), 9(*b*), 9(*c*) and 9(*d*) are schematic diagrams of circuit structures of pixel driving circuits provided by embodiments of the present disclosure.
Figure 9:
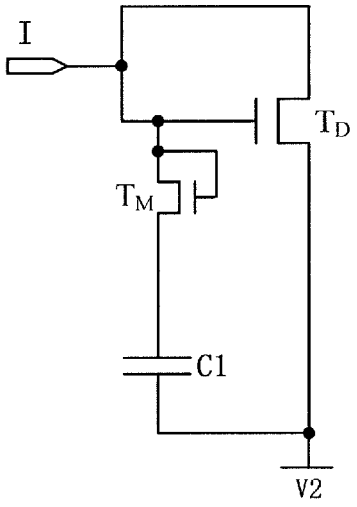
Figure 9:
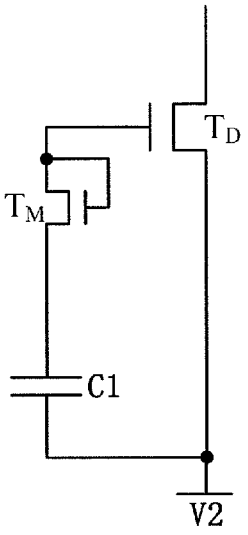
Figure 9:
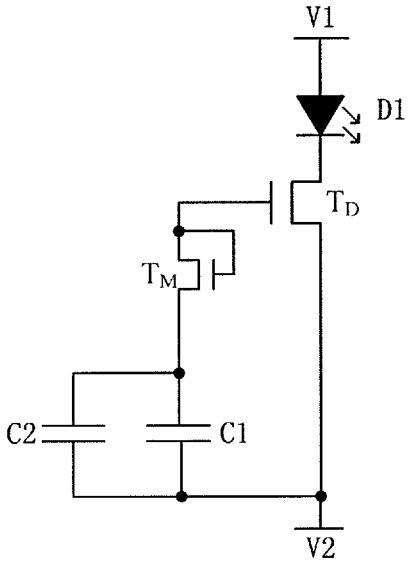

An exemplary structure of a pixel driving circuit provided by an embodiment of the present disclosure can be as shown in FIG. 6. In the embodiment of the present disclosure, for the pixel driving circuit shown in FIG. 6, a time sequence diagram for operation as shown in FIG. 8 is provided. FIG. 8 records the phases comprised in each operation period of the pixel driving circuit, which are a discharge phase, a programming phase, a buffer phase, and a light emitting phase (the time length of the light emitting phase is much larger than that of other phases) in time sequence. FIG. 8 also records the states (high voltage level or low voltage level) of the first control signal S(n), the second control signal EM(n) and the data current $I_{data}$ in each phase. Based on the time sequence diagram for operation, the pixel driving circuit shown in FIG. 6 has equivalent circuits in the discharge phase, the programming phase, the buffer phase, and the light emitting phase which can be respectively shown in FIG. 9(*a*), FIG. 9(*b*), FIG. 9(*c*), and FIG. 9(*d*).

In the discharge phase, S(n) and EM(n) are high voltage levels, $I_{data}$ is a low voltage level, the first transistor T1, the second transistor T2, the third transistor T3, the fourth transistor T4 and the fifth transistor T5 are all turned on, and the storage capacitor C1 and the voltage-reducing capacitor C2 are discharging to release the voltage $V_x$ stored in the last operation period. Although the light emitting part D1 emits light in the discharge phase, the light-emitting can be neglected since the time length of the discharge phase is much smaller than that of the light-emitting phase.

In the programming phase, S(n) and $I_{data}$ are high voltage levels, EM(n) is a low voltage level, the first transistor T1 is turned off, the voltage-reducing capacitor C2 and the storage capacitor C1 are disconnected, the third transistor T3 is turned off, the light emitting part D1 is disconnected, the fourth transistor T4 and the fifth transistor T5 are turned on to connect the gate and the drain of the driving transistor $T_D$, the driving transistor $T_D$ enters into the saturation state, one part of $I_{data}$ flows through the driving transistor $T_D$, the other part flows into the storage capacitor C1 through the matching transistor $T_M$ (equivalent to the diode) to charge the storage capacitor C1 until the voltage between the two terminals of the storage capacitor C1 does not change any more, now all $I_{data}$ flows through the driving transistor $T_D$, and now the sum of the voltage V1 between the two terminals of the storage capacitor C1 and the threshold voltage of the matching transistor $T_M$ is the gate-source voltage of the driving transistor $T_D$.

In the buffer phase, S(n), EM(n) and $I_{data}$ are all low voltage levels, the first transistor T1 is turned off, the voltage-reducing capacitor C2 and the second transistor T2 are disconnected, the third transistor T3 is turned off, the light emitting part D1 is disconnected, the fourth transistor T4 and the fifth transistor T5 are turned off, the gate and the drain of the driving transistor $T_D$ are disconnected, no current flows through the driving transistor $T_D$, and the storage capacitor C1 is in a stable state. When entering into the buffer phase, S(n) and $I_{data}$ are switched from high voltage levels to low voltage levels. When the buffer phase ends, EM(n) is just switched from a low voltage level to a high voltage level, and the time point of switching of S(n) and $I_{data}$ and the time point of switching of EM(n) are misaligned by a certain time length, which can prevent introducing noises due to simultaneous high/low voltage level switching of multiple signals.

In the light emitting phase, S(n) and $I_{data}$ are low voltage levels, EM(n) is a high voltage level, the third transistor T3 is turned on, the driving transistor $T_D$ is in the saturation state under the effect of VDD and VSS with preset voltage values, in addition, the first transistor T1 is turned on, the second transistor T2 is turned off, the voltage-reducing capacitor C2 and the storage capacitor C1 are connected in parallel, the two capacitors redistribute the charges of the storage capacitor C1, the voltage between the two terminals of the storage capacitor C1 decreases, $I_{oled}$ flows through the driving transistor $T_D$ and the light emitting part D1, the value of $I_{oled}$ can be calculated based on expression (5) in the above embodiment. $I_{oled}$ flows through the light emitting part D1 to make the light emitting part D1 emit light.

Figure 7:
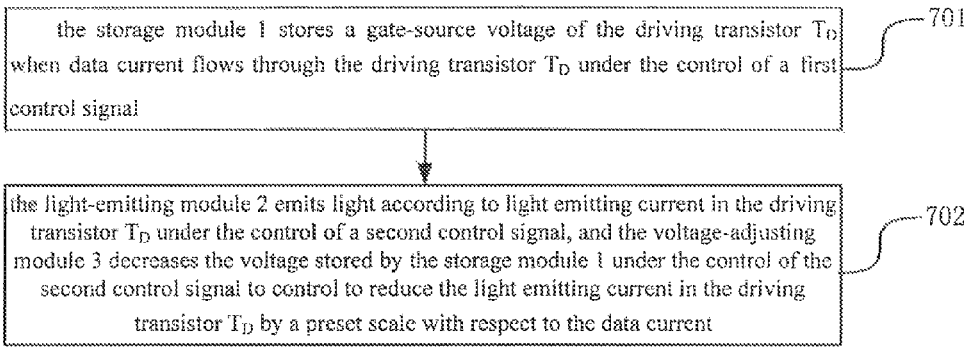
FIG. 7 is a schematic flowchart of a driving method of a pixel driving circuit provided by an embodiment of the present disclosure.

In the embodiment of the present disclosure, the voltage stored by the storage module is decreased by the voltage-adjusting module to control the light emitting current in the driving transistor to decrease by a preset scale with respect to the data current. As a result, it is possible to use relatively strong data current to trigger relatively weak light emitting current, improve storing speed when storing the gate-source voltage of the driving transistor, and thus improve display accuracy. Based on the pixel driving circuit provided in the above embodiment, an embodiment of the present disclosure also provides a driving method of a pixel driving circuit, as shown in FIG. 7, the process procedure of the method can comprise the following steps.

At step 701, the storage module 1 stores a gate-source voltage of the driving transistor $T_D$ when data current flows through the driving transistor $T_D$ under the control of a first control signal.

This step is the process of the storage module 1 and the driving transistor $T_D$ in the programming phase. In the programming phase, the light emitting module 2 and the voltage-adjusting module 3 may not work. An exemplary process procedure of the step can refer to related content in the above embodiments, which is not repeated here.

Optionally, before step 701, a discharge phase can be comprised. The process of the discharge phase can be as follows. The discharge module 4 discharges the storage capacitor C1 and the voltage-reducing capacitor C2 according to the first control signal.

This process is the process of the discharge module 4 in the discharge phase. An exemplary process procedure can refer to related content in the above embodiments, which is not repeated here.

In step 702, the light-emitting module 2 emits light according to light emitting current in the driving transistor $T_D$ under the control of a second control signal, and the voltage-adjusting module 3 decreases the voltage stored by the storage module 1 under the control of the second control signal to control to reduce the light emitting current in the driving transistor $T_D$ by a preset scale with respect to the data current.

This step is the process of the light emitting module 2, the voltage-adjusting module 3, the storage module 1 and the driving transistor $T_D$ in the light emitting phase. An exemplary process procedure of the step can refer to related content in the above embodiments, which is not repeated here.

Optionally, a buffer phase can be arranged between the programming phase and the light emitting phase. Accordingly, the process of the step 702 can be as follows. Upon reaching a preset time length after the storage module 1 finishes storing the gate-source voltage of the driving transistor $T_D$, the light-emitting module 2 emits light according to light emitting current in the driving transistor $T_D$ under the control of a second control signal, and the voltage-adjusting module 3 decreases the voltage stored by the storage module 1 under the control of the second control signal to control to reduce the light emitting current in the driving transistor $T_D$ by a preset scale with respect to the data current.

The preset time length is the time length duration of the buffer phase. By setting the buffer phase, the light emitting phase is entered after a certain time length from the ending of the programming phase, such that it is possible to prevent introducing noises due to simultaneous high/low voltage level switching of multiple signals.

In an embodiment of the present disclosure, for an exemplary structure of the pixel driving circuit shown in FIG. 6, a time sequence diagram for operation as shown in FIG. 8 is provided. FIG. 8 records the phases comprised in each operation period of the pixel driving circuit, which are a discharge phase, a programming phase, a buffer phase, and a light emitting phase (the time length of the light emitting phase is much larger than that of other phases) in time sequence. FIG. 8 also records the states (high voltage level or low voltage level) of the first control signal S(n), the second control signal EM(n) and the data current $I_{data}$ in each phase. Based on the time sequence diagram for operation, the pixel driving circuit shown in FIG. 6 has equivalent circuits in the discharge phase, the programming phase, the buffer phase, and the light emitting phase which can be respectively shown in FIG. 9(*a*), FIG. 9(*b*), FIG. 9(*c*), and FIG. 9(*d*).

The exemplary process procedure of each phase can refer to the related content in the above embodiments.

In an embodiment of the present disclosure, the voltage stored by the storage module is decreased by the voltage-adjusting module to control the light emitting current in the driving transistor to decrease by a preset scale with respect to the data current. As a result, it is possible to use relatively strong data current to trigger relatively weak light emitting current, improve storing speed when storing the gate-source voltage of the driving transistor, and thus improve display accuracy. An embodiment of the present disclosure provides a display apparatus comprising the pixel driving circuit described in the above embodiments.

In an embodiment of the present disclosure, the voltage stored by the storage module is decreased by the voltage-adjusting module to control the light emitting current in the driving transistor to decrease by a preset scale with respect to the data current. As a result, it is possible to use relatively strong data current to trigger relatively weak light emitting current, improve storing speed when storing the gate-source voltage of the driving transistor, and thus improve display accuracy.

The order of the above embodiments of the present disclosure is only for description, but does not represent merit rating of the embodiments.

Those skilled in the art can understand that all or part of the steps realizing the above embodiments can be implemented by hardware, or by programs instructing related hardware. The programs can be stored in a computer readable storage medium which can be a ROM, a magnetic disk, an optical disk, or the like.

The above descriptions are only preferable embodiments of the present disclosure, but are not used to limit the present disclosure. Any modification, equivalent exchange, improvement or the like within the spirit and principle of the present disclosure should fall within the protection scope of the present disclosure.

The present application claims the priority of Chinese Patent Application No. 201510051381.0 filed on Jan. 30, 2015, entire content of which is incorporated as part of the present invention by reference.

What is claimed is:

1. A pixel driving circuit comprising a storage module, a light emitting module, a driving transistor and a voltage-adjusting module, wherein the storage module is connected to a first control signal terminal, a data current input terminal, the driving transistor and the voltage-adjusting module respectively, and is configured to store a gate-source voltage of the driving transistor when data current flows through the driving transistor under the control of a first control signal, and comprises at least a storage capacitor and a matching transistor connected to each other in series, and wherein the matching transistor and the driving transistor have the same threshold voltage;

the light-emitting module is connected to a second control signal terminal, a power voltage terminal and the driving transistor respectively, and is configured to emit light according to the light emitting current in the driving transistor under the control of a second control signal;

the voltage-adjusting module is connected to the second control signal terminal and the storage module respectively, and is configured to decrease the voltage stored by the storage module under the control of the second control signal to control to reduce the light emitting current in the driving transistor by a preset scale with respect to the data current.

2. The pixel driving circuit according to claim 1, wherein the voltage-adjusting module comprises a voltage-reducing capacitor and a first transistor; and the first transistor is arranged in a branch where the voltage-reducing capacitor connects with the storage capacitor in parallel, and is configured to control the voltage-reducing capacitor to be connected with the storage capacitor in parallel according to the second control signal.

3. The pixel driving circuit according to claim 2, wherein the pixel driving circuit further comprises:

a discharge module which is configured to discharge the storage capacitor and the voltage-reducing capacitor before the storage module stores the gate-source voltage of the driving transistor under the control of the first control signal.

4. The pixel driving circuit according to claim 3, wherein the discharge module comprises a second transistor.

5. The pixel driving circuit according to claim 1, wherein the light-emitting module comprises a light-emitting device and a third transistor; and the light-emitting device is arranged in a line between the third transistor and the power voltage terminal.

6. The pixel driving circuit according to claim 1, wherein the storage module further comprises a fourth transistor and a fifth transistor which are arranged in a line connecting a gate and a source of the driving transistor and are connected to the first control signal terminal and the data current input terminal respectively;

the fourth transistor and the fifth transistor are configured to connect the gate and the source of the driving transistor and input the data current into the source of the driving transistor and the storage capacitor under the control of the first control signal.

7. A display apparatus comprising pixel driving circuits according to claim 1.

8. The pixel driving circuit according to claim 1, wherein the light-emitting module comprises a light-emitting device and a third transistor; and the light-emitting device is arranged in a line between the third transistor and the power voltage terminal.

9. The pixel driving circuit according to claim 2, wherein the light-emitting module comprises a light-emitting device and a third transistor; and the light-emitting device is arranged in a line between the third transistor and the power voltage terminal.

10. The pixel driving circuit according to claim 3, wherein the light-emitting module comprises a light-emitting device and a third transistor; and the light-emitting device is arranged in a line between the third transistor and the power voltage terminal.

11. The pixel driving circuit according to claim 4, wherein the light-emitting module comprises a light-emitting device and a third transistor; and the light-emitting device is arranged in a line between the third transistor and the power voltage terminal.

12. The pixel driving circuit according to claim 2, wherein the storage module further comprises a fourth transistor and a fifth transistor which are arranged in a line connecting a gate and a source of the driving transistor and are connected to the first control signal terminal and the data current input terminal respectively;

the fourth transistor and the fifth transistor are configured to connect the gate and the source of the driving transistor and input the data current into the source of the driving transistor and the storage capacitor under the control of the first control signal.

13. The pixel driving circuit according to claim 3, wherein the storage module further comprises a fourth transistor and a fifth transistor which are arranged in a line connecting a gate and a source of the driving transistor and are connected to the first control signal terminal and the data current input terminal respectively;

the fourth transistor and the fifth transistor are configured to connect the gate and the source of the driving transistor and input the data current into the source of the driving transistor and the storage capacitor under the control of the first control signal.

14. The pixel driving circuit according to claim 4, wherein the storage module further comprises a fourth transistor and a fifth transistor which are arranged in a line connecting a gate and a source of the driving transistor and are connected to the first control signal terminal and the data current input terminal respectively;

the fourth transistor and the fifth transistor are configured to connect the gate and the source of the driving transistor and input the data current into the source of the driving transistor and the storage capacitor under the control of the first control signal.

15. The pixel driving circuit according to claim 5, wherein the storage module further comprises a fourth transistor and a fifth transistor which are arranged in a line connecting a gate and a source of the driving transistor and are connected to the first control signal terminal and the data current input terminal respectively;

the fourth transistor and the fifth transistor are configured to connect the gate and the source of the driving transistor and input the data current into the source of the driving transistor and the storage capacitor under the control of the first control signal.

16. A driving method of a pixel driving circuit, comprising:

a storage module storing a gate-source voltage of a driving transistor when data current flows through the driving transistor under the control of a first control signal, wherein the storage module comprises at least a storage capacitor and a matching transistor connected to each other in series, and wherein the matching transistor and the driving transistor have the same threshold voltage; and a light-emitting module emitting light according to light emitting current in the driving transistor under the control of a second control signal, and a voltage-adjusting module decreasing the voltage stored by the storage module under the control of the second control signal to control to reduce the light emitting current in the driving transistor by a preset scale with respect to the data current.

17. The method according to claim 16, wherein before the storage module stores the gate-source voltage of the driving transistor when the data current flows through the driving transistor under the control of the first control signal, the method further comprises:

a discharge module discharging a storage capacitor and a voltage-reducing capacitor according to the first control signal.

18. The method according to claim 16, wherein the light-emitting module emitting light according to light emitting current in the driving transistor under the control of the second control signal, and the voltage-adjusting module decreasing the voltage stored by the storage module under the control of the second control signal to control to reduce the light emitting current in the driving transistor by a preset scale with respect to the data current comprises:

upon reaching a preset time length after the storage module finishes storing the gate-source voltage of the driving transistor, the light-emitting module emitting light according to light emitting current in the driving transistor under the control of the second control signal, and the voltage-adjusting module decreasing the voltage stored by the storage module under the control of the second control signal to control to reduce the light emitting current in the driving transistor by a preset scale with respect to the data current.

19. The method according to claim 17, wherein the light-emitting module emitting light according to light emitting current in the driving transistor under the control of the second control signal, and the voltage-adjusting module decreasing the voltage stored by the storage module under the control of the second control signal to control to reduce the light emitting current in the driving transistor by a preset scale with respect to the data current comprises:

upon reaching a preset time length after the storage module finishes storing the gate-source voltage of the driving transistor, the light-emitting module emitting light according to light emitting current in the driving transistor under the control of the second control signal, and the voltage-adjusting module decreasing the voltage stored by the storage module under the control of the second control signal to control to reduce the light emitting current in the driving transistor by a preset scale with respect to the data current.

* * * * *